US006742879B2

(12) United States Patent
Jones et al.

(10) Patent No.: US 6,742,879 B2
(45) Date of Patent: Jun. 1, 2004

(54) DUAL CHAMBER INK-JET CARTRIDGE

(75) Inventors: Bruce S. Jones, Franklin, TN (US); Stephen A. Anderson, Thompson Station, TN (US); Patrick D. Carter, Fairview, TN (US); William A. Putman, Franklin, TN (US)

(73) Assignee: Seiko Epson Corporation, Nagano (JP)

( * ) Notice: Subject to any disclaimer, the term of this patent is extended or adjusted under 35 U.S.C. 154(b) by 0 days.

(21) Appl. No.: 10/148,862

(22) PCT Filed: Oct. 5, 2001

(86) PCT No.: PCT/US01/31336

§ 371 (c)(1),
(2), (4) Date: Jun. 4, 2002

(87) PCT Pub. No.: WO02/28653

PCT Pub. Date: Apr. 11, 2002

(65) Prior Publication Data

US 2002/0180847 A1 Dec. 5, 2002

Related U.S. Application Data

(60) Provisional application No. 60/239,080, filed on Oct. 6, 2000, and provisional application No. 60/239,076, filed on Oct. 6, 2000.

(51) Int. Cl.[7] ..... B41J 2/05

(52) U.S. Cl. ..... 347/86

(58) Field of Search ..... 347/84–87

(56) References Cited

U.S. PATENT DOCUMENTS

| | | | | |
|---|---|---|---|---|
| 5,875,615 A | * | 3/1999 | Ito et al. | 347/86 |
| 6,170,941 B1 | * | 1/2001 | Hara et al. | 347/86 |
| 6,238,042 B1 | * | 5/2001 | Kobayashi et al. | 347/86 |
| 6,454,387 B1 | * | 9/2002 | Haldorsen | 347/86 |

FOREIGN PATENT DOCUMENTS

| | | | | |
|---|---|---|---|---|
| JP | 363009547 A | * | 1/1988 | 347/87 |

* cited by examiner

*Primary Examiner*—Stephen D. Meier
*Assistant Examiner*—An H. Do
(74) *Attorney, Agent, or Firm*—Squire, Sanders & Dempsey, LLP

(57) ABSTRACT

An ink tank cartridge (A) includes a housing (10) having a bottom wall (28) and a plurality of side walls (12, 14, 16, 18) forming a cavity (20). A divider wall (22) is positioned within the cavity to divide the cavity into first and second chambers (24, 26). An ink supply port (42) projects from the bottom wall of the housing. A porous member (40) is accommodated in the chamber having the ink supply port. The other chamber is partially filled with ink. The divider wall has an opening (30) allowing ink to pass from one of the chambers to the other chamber. A cover (50) having a fill hole (94) is secured to the housing.

18 Claims, 2 Drawing Sheets

DUAL CHAMBER INK-JET CARTRIDGE

CROSS-REFERENCE TO RELATED APPLICATIONS

This application claims priority from Provisional Application Nos. 60/239,080 and 60/239,076 filed on Oct. 6, 2000.

BACKGROUND OF THE INVENTION

This invention relates generally to the ink-jet printing art for ejecting ink droplets on a recording medium such as paper, and more particularly, to an ink tank cartridge for use in an ink-jet type recording apparatus such as a printer.

In a conventional recording apparatus, ink is supplied to a recording head from an ink tank constructed as a cartridge. A benefit of using an ink cartridge serving as an ink tank is that ink does not smear due to the leakage of ink while refilling new ink or the like. However, undesired air bubbles can easily enter the ink tank during the filling process which cause problems such as ink supply failure. Controlling the flow of ink from the cartridge is also a concern. When ink is supplied from an ink tank, ink in the tank remote located in a region from the supply port flows toward the supply port as a result of a pressure difference. Capillary attraction in an ink impregnated member or foam in the vicinity of the supply port is increased due to ink consumption.

A cartridge can also be divided into multiple chambers, where a porous foam or material is positioned over an outlet port in one chamber and free ink is filled into the other chamber. The free ink migrates from its chamber into the foam through an opening providing communication between the two chambers. The foam then controls the flow of ink as it migrates toward the ink outlet port.

It is desirable to develop a new and improved ink cartridge which would provide better, more advantageous overall results.

SUMMARY OF THE INVENTION

Generally speaking, in accordance with the invention, an ink tank cartridge is provided for an ink-jet type recording apparatus removably mounted on an ink supply needle of a recording body.

More particularly, the invention relates to an ink tank cartridge used for an ink-jet type recording apparatus which is removably mountable onto an ink supply needle of the recording apparatus. The ink tank cartridge includes a housing having a bottom wall and a plurality of side walls forming a cavity. A divider wall is positioned within the cavity to divide the cavity into first and second chambers. An ink supply port provides an opening that extends through a bottom wall located in one of the chambers of the housing.

A porous member is accommodated in one of the chambers. The porous member has ink impregnated therein and abuts the opening in the bottom wall. A groove is formed in the bottom wall to direct and transfer ink from the porous member to the ink supply port. A filter is positioned between the ink supply port and the porous member. The porous member comprises porous hydrophilic foam and has pores of larger size than the pores in the filter. The filter is thermally sealed over the grooves and ink supply port. The other chamber is partially filled with ink. The divider wall has an opening allowing ink to pass from the ink chamber(s) to the foam chamber.

A seal member is inserted into the ink supply port. A retaining member holds the seal member in place. The cartridge further comprises a cover which is secured to the housing. The cover has at least one vent hole and at least one fill hole. A plug is inserted into the fill hole to maintain negative pressure in the cartridge. Ink is pressure filled into the cartridge through the fill hole after the cartridge is subjected to a vacuum or negative pressure. A seal is subsequently attached to the cover to seal the cover.

Still other aspects of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 1:
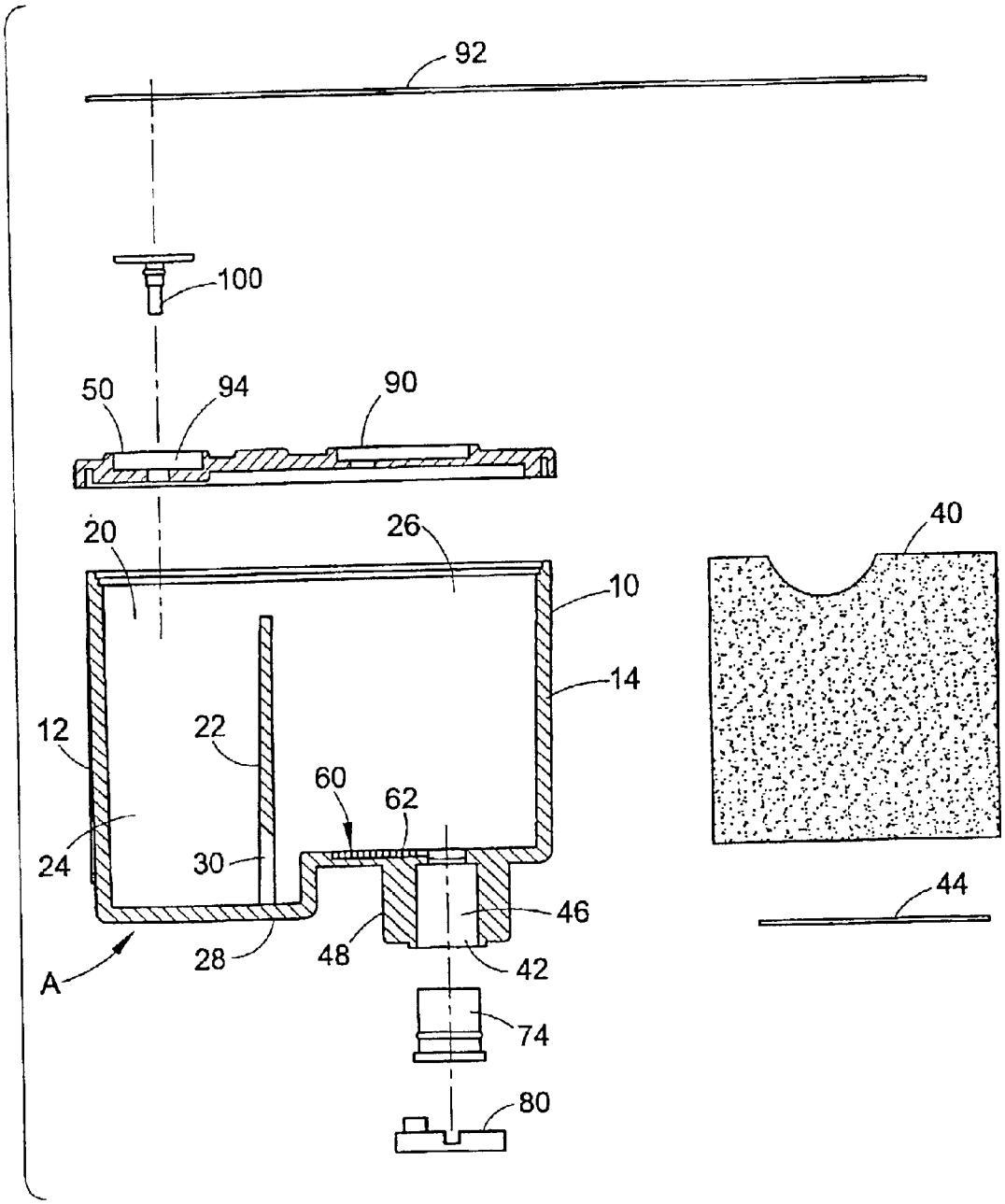
FIG. 1 is an exploded elevational view of an ink cartridge according to a preferred embodiment of the present invention.

Referring now to the drawings, wherein the showings are for purposes of illustrating a preferred embodiment of the invention only and not for purposes of limiting same, FIG. 1 shows an ink tank cartridge A according to the present invention.

More specifically, the ink tank cartridge comprises a case or housing 10 which defines an internal cavity of a generally rectangular cross section. The housing has a series of walls 12, 14, 16, 18 which form an internal cavity 20. The housing may be tapered slightly in such a manner that the bottom surface is smaller in cross-sectional area than the top surface. Alternatively, the housing may be formed with straight walls. An additional dividing wall 22 separates the housing internal cavity into two smaller chambers 24,26. Here, the chambers are substantially equally sized. The wall 22 extends laterally between opposed sides of the housing and extends upwardly from a bottom wall 28 to an open top end of the housing effectively dividing the internal cavity into discrete first and second chambers. An opening 30 extends through a lower region of the wall 22 adjacent the bottom wall placing the chambers into communication with each other for ink storage and transfer purposes. Chamber 24 is used to store free ink while chamber 26 is used to store ink in an ink absorbing or porous member 40.

The ink absorbing member comprises a block of porous material or foam and is preferably formed of Melamine™ or hydrophilic foam. It will be appreciated, however, that other materials may be used for storing ink without departing from the scope and intent of the present invention. The absorbing member is disposed in chamber 26 adjacent an outlet port 42. The outlet port 42 is positioned within the bottom wall of the housing. A filter or screen 44 is inserted in the cartridge over the outlet port prior to inserting the ink absorbing member. The screen is interposed between the ink absorbing member and the outlet port to prevent egress of air bubbles, contaminants, and the like from the cartridge. The outlet port 42 comprises an opening 46 and a pipe-like or chimney member 48 which extends from the bottom wall of the housing. Opening 46 is in communication with an opening 49 (FIG. 3) within the bottom wall.

Figure 2:
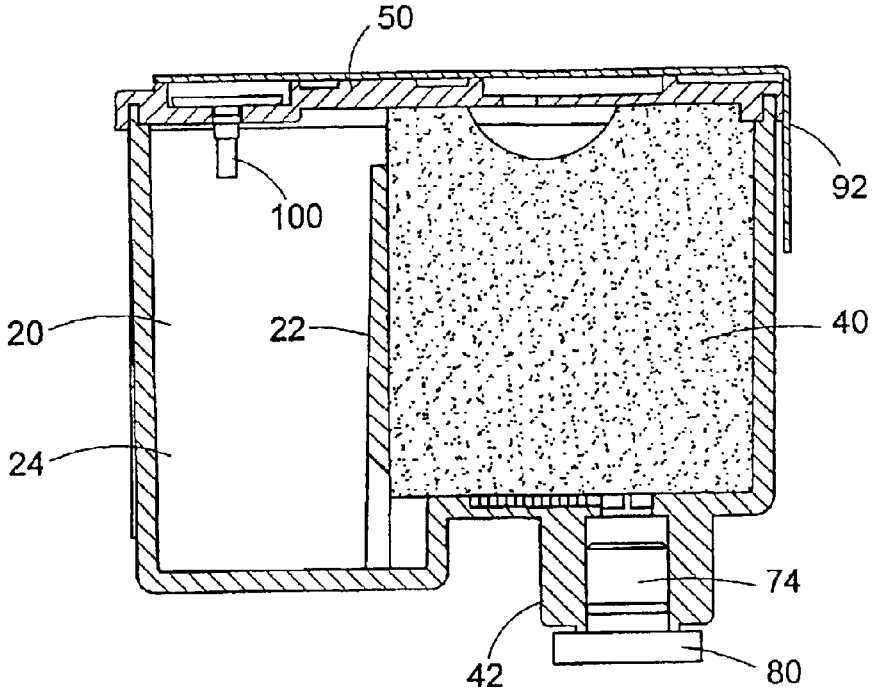
FIG. 2 is a side elevational view in cross section of the ink cartridge of FIG. 1 in an assembled configuration; and, FIG. 3 is a top plan view of the interior of the ink cartridge of FIG. 1.

Referring to FIG. 2, after the ink absorbing member has been installed and properly positioned in the first chamber, a cover 50 is fixedly secured to the housing, for example, by ultrasonic welding. The height of the ink absorbing member is slightly less than the inside height of the housing as measured between the bottom wall and the underside of the cover. Thus, there is no compression of the ink absorbing member in the vertical direction.

The ink absorbing member has pore sizes which are larger than those in the filter screen. The ink absorbing member may be constructed with a cross-sectional width slightly greater than the chamber of the housing. Filter 44 is preferably comprised of mesh, such as a woven material, and having a pore size of about 0.5–100 micron, and preferably 1–20 microns, and is secured over the inner opening of the ink supply port, for example by fuse bonding the filter to the bottom wall of the housing.

Figure 3:
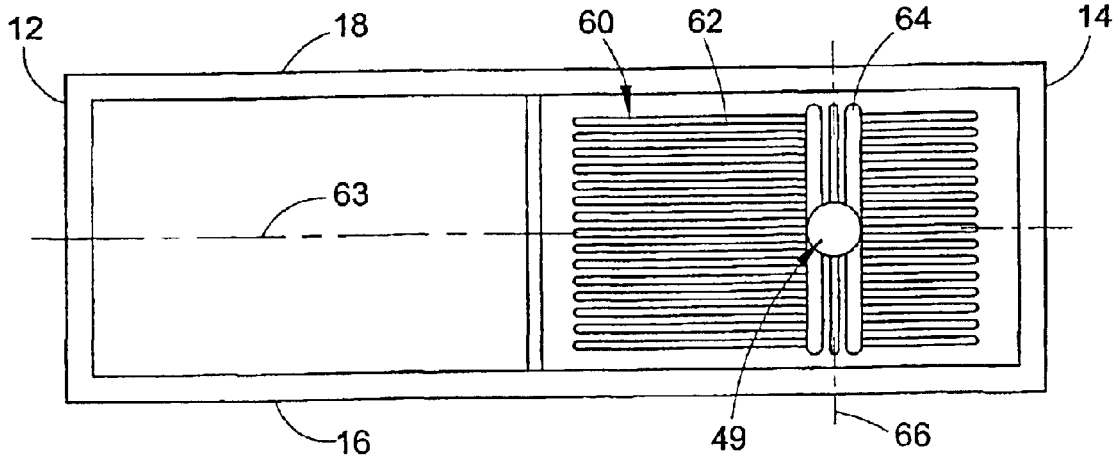

The filter screen is thermally sealed over a recessed groove 60 located within the bottom wall of the cartridge forming a geometric pattern in the preferred embodiment. As seen in FIG. 3, the grooves 62 extend along a longitudinal axis 63 of the housing from the outlet port and are used to transfer or convey ink to the outlet port. These grooves are approximately parallel to each other and are equally spaced apart. The width of each groove is approximately the same as the space between the grooves. A second set of grooves 64 are disposed along a transverse axis 66. These grooves are preferably of a greater width than grooves 62 and serve as sinks or drain wells to aid the ink flow into the outlet port. It should be noted that other groove configurations may be used that serve these same objectives of effectively conveying ink toward the outlet port.

A seal member or grommet 74 is inserted into the external chimney 48 of the housing through opening 46. Each grommet is a generally cup-shaped silicone membrane with a flexible portion and is disposed with an open end facing toward the interior of the housing. A web of material is disposed closely adjacent the other, or outer, end which closes the grommet end. The closed end of the grommet is pierced by a needle associated with the printer to create an ink supply or withdraw opening only when and as the cartridge is mounted in a printer. A grommet retaining ring 80 is placed onto the outer end of the chimney over each grommet and is ultrasonically welded into place in the preferred embodiment. The grommet ring has an enlarged central opening (not shown) to provide access to the grommet and outlet port. Also, the ring includes slots that align with and receive terminal ends of extending ribs on the chimneys.

The cover has vent channels or holes 90 that are preferably recessed in the cover. The cover is at least partially sealed with a laminated or plastic seal 92 which is thermally attached over the vent channels of the cover. The fill hole 94 in the cover is initially left unsealed. A negative pressure is applied to remove air from the cartridge. For example, the porous member of the cartridge is exposed to a pre-vacuum of 27.5 in Hg maximum within the cartridge. This removes air from the open cells within the porous foam.

The cartridge is filled with a water-based inkjet type ink through the fill hole 94 of the cover using degassed ink. The ink is degassed through a cyclic degassing procedure prior to being filled into the cartridge. Either black ink or different color inks, i.e., cyan, magenta, and yellow ink, are introduced into a chamber(s) of the cartridge. The ink is then introduced under pressure into the cartridge through a hollow needle to maximize the amount of ink for consumer end use and minimize the likelihood of air bubble entrapment. A silicone rubber check valve 100 is inserted into the cover by inserting a stem of the valve into a recessed side of the key way slot or fill hole 94. The stem is then pulled with a slow, steady force to assemble the valve to the cover and maintain the desired pressure in the cartridge.

After filling, the cartridge is inserted into a seal fixture to seal the cartridge for shipping and storage. Then the other half of the seal film 92 is thermally sealed over the valve 100 to keep air from entering into the interior of the cartridge. The valve acts as a one-way valve to allow air to escape and not reenter the cartridge. Later, prior to shipment, the cartridge is preferably covered or shrink wrapped with air permeable cellophane type material.

A preferred method of assembling the dual chamber cartridge includes the step of placing the filter 44 into the chamber of the housing over the outlet port 42. The housing is next inserted into a fixture associated with a vacuum source for applying a vacuum or negative pressure through the outlet port to hold the filter screen in position over the recessed geometric pattern in the bottom wall of the cartridge. Then, a pneumatic cylinder is used to press a heated anvil onto the top surface of the filter causing the outer ends of the filter to fuse to the housing. The housing is then removed from the fixture and the rubber seal grommet 72 is pushed into the ink outlet port from the bottom and is locked into position by either thermally, i.e. ultrasonically or by other means, and the retaining ring 80 is attached over the opening. Alternately, the side wall of the retaining ring is fused on the chimney 48 over the opening to hold the grommet in place. The ink absorbing member or foam 40 is then inserted into the chamber over the filter.

The cover 50 is attached to the top wall of the cartridge. Although the cover is thermally fused or ultrasonically welded to the housing in accordance with the present invention, it will be appreciated that alternative manners of securing the cover to the housing can be used. The cartridge with the sealed cover assembly is then placed into a holding fixture that effects a seal around the fill hole 94 and a negative pressure or vacuum is applied to the cavity through the fill hole. This substantially eliminates all voids within the ink absorbing member and the chamber to maximize the amount of ink that can be stored within the cartridge. Ink is degassed prior to filling by a cyclic degassing method. The ink is then injected into the cartridge under pressure by means of a hollow needle extending through the fill hole. The valve 100 is then inserted into the fill hole and is locked into place via the valve stem such that an enlarged head of the valve covers the entire ink fill hole.

At least half of the cover with recess vent channels 90 is sealed with a plastic seal or laminate 92 through a heated pneumatic press and heated pad. Then the cover is removed from the press and inserted into the vacuum chamber where negative pressure is used to then remove any residual air from the inside of the chamber to keep air from mixing with the ink during transportation. The laminate 92 is thoroughly attached to the remaining part of the cover over the valve to preclude air from entering the cartridge.

The invention has been described with reference to the preferred embodiment. Obviously, alterations and modifications will occur to others upon a reading and understanding of this specification. It is intended to include all such modifications and alterations insofar as they come within the scope of the appended claims or the equivalents thereof.

Having thus described the preferred embodiment, the invention is now claimed to be:

1. An ink tank cartridge for an associated ink-jet type recording apparatus being removably mountable onto an associated ink supply needle of the ink jet type recording apparatus, said ink tank cartridge comprising:

a housing having a cavity formed therein;

a divider wall positioned within said cavity to divide said cavity into a first chamber and a second chamber;

an ink outlet port extending through said housing at a bottom of said first chamber;

a porous member accommodated in said first chamber, said porous member having ink impregnated therein and abutting the housing adjacent the ink outlet port;

a recessed groove pattern formed in said housing at the bottom of said first chamber to direct and transfer ink from said porous member to said ink outlet port said recessed groove pattern including at least a first plurality of approximately parallel, equal width and equally spaced grooves; and a filter positioned between said ink outlet port and said porous member;

wherein said second chamber is at least partially filled with ink, said divider wall having an opening allowing said ink to pass from said second chambers to said first chambers.

2. The ink tank cartridge of claim 1, further comprising a seal member which is inserted into said ink outlet port.

3. The ink tank cartridge of claim 2, further comprising a retaining member which is attached to said seal member to hold said seal member in place.

4. The ink tank cartridge of claim 1, wherein said porous member comprises porous hydrophilic foam.

5. The ink tank cartridge of claim 1, wherein said porous member has pores of larger size than pores in said filter.

6. The ink tank cartridge of claim 1, wherein said filter is sealed over said recessed groove pattern and said ink supply port.

7. The ink tank cartridge of claim 1, further comprising a cover which is sealed to said housing.

8. The ink tank cartridge of claim 7, wherein said cover comprises at least one vent hole and at least one fill hole.

9. The ink tank cartridge of claim 8, further comprising a plug which is inserted into said fill hole to allow negative pressure to be applied to said cartridge.

10. The ink tank cartridge of claim 7, further comprising a seal for sealing said cover.

11. A method for making an ink tank cartridge for an ink-jet type recording apparatus, comprising the steps of:

forming a housing defining a cavity therein with a divider wall positioned within said cavity to divide said cavity into a first chamber and a second chamber, said housing having a recessed groove pattern formed in a bottom interior surface of said first chamber, said recessed groove pattern including at least a first plurality of approximately parallel, equal width and equally spaced grooves, said housing having an ink outlet port extending through said housing at a bottom of said first chamber;

inserting a filter into said cavity of said housing;

holding the filter in place within the housing with negative pressure applied through an outlet port of the housing;

sealing the outlet port with a seal member;

inserting a porous member into the housing above the filter and ink outlet port;

placing a cover on a top end of the housing and sealing the cover thereto;

placing the cartridge under a negative pressure to substantially eliminate voids in the porous member;

injecting degassed ink into the cartridge under pressure; and sealing the cartridge.

12. The method of claim 11, further comprising the step of:

pressing a heated member into said filter to fuse edges of filter into a bottom wall of the housing.

13. The method of claim 11, further comprising the step of:

attaching a retaining member around an end of the ink outlet port.

14. The method of claim 11, further comprising the step of:

placing the cartridge into a fixture and sealing a fill hole with a plug as negative pressure is applied to substantially eliminate all voids with seal cartridge.

15. The method of claim 14 further comprising the step of:

injecting the ink into the cartridge under a positive pressure.

16. The method of claim 11, further comprising the step of:

sealing approximately half the cover with a laminate.

17. The method of claim 16, further comprising the steps of:

removing the cartridge from the heating press and introducing the cartridge to a negative pressure to substantially remove residual air from the cartridge.

18. The method of claim 17, further comprising the step of:

reinserting the cartridge into the heated press to thermally attach the laminate over a plug.

* * * * *